United States Patent [19]

Burov et al.

[11] 4,448,048

[45] May 15, 1984

[54] CONTINUOUS LINE FOR IRRADIATION AND CHEMICAL TREATMENT OF TEXTILE WEBS

[75] Inventors: Vadim K. Burov; Boris M. Vanjuskin; Anatolij E. Voskoboev; Nikolaj G. Kon'kov; Vsevolod D. Orechov; Konstantin D. Pismannik, all of Moscow; Michail P. Svin'in; Michail I. Fedotov, both of Leningrad, all of U.S.S.R.; Werner Damerau, Kambs/Bützow, German Democratic Rep.; Achim Dulling; Adolf Heger, both of Dresden, German Democratic Rep.; Gerd Reichardt, Gera, German Democratic Rep.; Gotthard Wilde, Berlin, German Democratic Rep.

[73] Assignees: VEB Kombinat Textima, Karl Marx Stadt, German Democratic Rep.; Zentrales wissenschaftliches Forschungsinstitut der Baumwollindustrie; Allunions-Forschungsinstitut für Strahlentecknik, both of Moscow, U.S.S.R.; Allunions-Forschungsinstitut für physikalischen Apparatebau, Leningrad, U.S.S.R.

[21] Appl. No.: 335,396

[22] Filed: Dec. 29, 1981

[30] Foreign Application Priority Data

Feb. 10, 1981 [DD] German Democratic Rep. ..... 2275203

[51] Int. Cl.[3] ..... D06B 3/10; D06B 23/18

[52] U.S. Cl. ..... 68/5 E; 68/9; 68/13 R

[58] Field of Search ..... 68/5 D, 5 E, 9, 13 R; 34/1, 158, 162; 219/10.61 R, 10.55 R

[56] References Cited

U.S. PATENT DOCUMENTS

| | | | |
|---|---|---|---|
| 3,098,260 | 7/1963 | Richeson | 68/5 E |
| 3,307,381 | 3/1967 | Devylerre | 68/5 E |
| 3,327,367 | 6/1967 | Dungler | 34/162 |
| 3,369,306 | 2/1968 | Evans | 34/162 |
| 3,927,540 | 12/1975 | Tanaka et al. | 68/5 E |
| 4,169,707 | 10/1979 | Gloeckler | 68/5 D |
| 4,268,977 | 5/1981 | Geiger | 68/5 E |
| 4,274,209 | 6/1981 | Kawaguchi | 219/10.55 R |

FOREIGN PATENT DOCUMENTS 139073 12/1979 German Democratic Rep. .

*Primary Examiner*—Philip R. Coe
*Assistant Examiner*—Michael Knick
*Attorney, Agent, or Firm*—Michael J. Striker

[57] ABSTRACT

A continuous line for chemical treatment and irradiation of a textile web has an irradiation station provided with an outer protective jacket which has elongated openings for passing through the upper and lower runs of the conveyor. The ray exit window in the range of the outer protective jacket is enclosed by an inner protective jacket defining openings for the upper run of the conveyor supporting the web. To reduce leakage, the inner openings are vertically offset relative to the openings in the outer jacket, and the chains in the upper and lower runs of the conveyor are enclosed in protective casings, of which the upper-run casing is provided with slots for guiding the web. Ray-screening means in the form of displaceable screening blocks are provided in the range of the inner and outer openings and are movable together with the guiding channels. The irradiation station is equipped with radiation sensors for controlling radiation leakage, the dose and the maximum width of the treated web so as to stop the entire line, including the accelerator, when predetermined values are exceeded.

6 Claims, 6 Drawing Figures

CONTINUOUS LINE FOR IRRADIATION AND CHEMICAL TREATMENT OF TEXTILE WEBS

BACKGROUND OF THE INVENTION

The present invention relates in general to continuous treatment lines for textile webs and, in particular to a line for irradiation and chemical treatment of the webs, including a web supply station, a station for treating the webs by a liquid, and an irradiation station having a ray accelerator provided with a ray exit window, a washing station, a drying station, take-up means with a web-storing station, and transport means for feeding the web between the stations and cooperating with control means for regulating the advance of the web and for spreading the web on the feeding means. The line is suitable, for instance, for the manufacture of hydrophilic, antistatic or antibacterial webs. The treatment of such webs is effected by means of electron rays, and consequently an effective protection or screening against the electron radiation from such progressive lines is of particular importance.

A continuous processing line for irradiation and chemical treatment of textile webs is known, which consists of a device for supplying a web to be treated from a store, a device for treating the web in liquid, a device for irradiation of the web by means of a ray accelerator including ray-screening means, a washing device, drying devices, a device for taking up and storing the finished web, and further including a mechanism for effecting the feeding of the web between respective treatment stations and cooperating with a control device for regulating the advance of the web. This known arrangement has been described, for example, in DD Pat. No. 139 073; the ray-screening means described in this patent includes a system of deviation rollers arranged in the range of inlet and outlet openings for the web in the ray-screening walls which facilitate a bound guiding of the web, on the one hand, and cover the inlet and outlet slots to such an extent that the rays cannot leak through the screening walls.

The disadvantage of such known guiding rollers, however, is the fact that the web to be treated in the area of the irradiation device cannot be guided so accurately as is frequently desired. Such an accurate guidance is unconditionally necessary in the case when high-energy irradiation is employed and a uniform effect over the entire length and width of the web is desired. For this purpose, the web must be guided past a ray exit window of the irradiating device in a plane which is exactly parallel to the plane of the window, and such an exact guidance is frequently unattainable by means of prior-art guiding rollers. The exact guidance is particularly difficult to achieve with webs having edges susceptible to curling or rolling-in, as is the case with knitted fabrics, and the like.

In addition, a short-term intensive treatment by radiation causes such changes in the molecular structure of the fibers which results in a change in the size of the web, particularly in an undesired shrinkage both in longitudinal and transverse directions; at the same time, the variation in transverse dimension due to the tension exerted by guiding rollers in longitudinal direction on the web is still increased.

Accordingly, such prior-art guiding rollers are in practice limited to certain applications only and are unsuitable for all kinds of webs to be treated.

SUMMARY OF THE INVENTION

It is therefore a general object of the present invention to overcome the aforementioned disadvantages.

More particularly, it is an object of the invention to provide an improved progressive line of the above-described type which is suitable for treating a variety of textile webs by means of irradiation.

Another object of this invention is to provide such an improved line which prevents leakage of radiation even at high intensities.

An additional object of the invention is to provide such an improved processing line which provides for an accurate and reliable guidance of the web past the exit window of the radiation station.

In keeping with these objects and others which will become apparent hereafter, one feature of the invention resides, in a treatment line of the above-described type, in the provision of a chain conveyor having a transversely adjustable upper run for feeding the web between the stations, and having also a lower run, control means coupled to the conveyor means for regulating the spreading and advance of the web supported on the upper run; the irradiation station being formed with an outer protective jacket provided with outer openings for passing through at least the upper run of the conveyor together with the web, and with an inner protective jacket surrounding the exit window of the ray accelerator, and being provided with inner openings for passing through the upper run with the web, the inner openings and the corresponding outer openings being vertically offset relative to each other; guiding means arranged in the irradiation station for adjusting the breadth of the upper and lower runs, the guiding means for the upper run having a substantially horizontal central section extending between the inner openings of the inner protective jacket, and two sloping lateral sections extending between the outer openings in the outer protective jacket and the inner openings, respectively; and displaceable ray-shielding blocks arranged for movement along the inner and outer openings and cooperating with the control means to move in a direction transverse to the web-feeding direction. The guiding means have the form of guiding channels or casings enclosing the chains of the upper run of a chain conveyor and being provided with slots for guiding the edges of the web. The position-adjustable protective or screening blocks are mechanically connected to the guiding channels and are controlled by a control unit responsive to the intensity of radiation and to the technological requirements of the entire processing line.

In an embodiment of the processing line of this invention, both the upper run and the lower run of the chain conveyor pass through the irradiation station, whereby the guiding channel or casing for the lower run is completely closed, whereas the inner sides of the guiding channels or casings for the upper run are provided with a guiding slot extending along the entire length of the guiding channels for permitting the attachment of the web.

In order to couple the system of displaceable ray-screening blocks with the control device for the processing line, the control unit includes radiation sensors arranged near the outer surface of the outer protective jacket, radiation sensors arranged within the outer and inner protective jackets near the outer and inner openings for the guiding means and sensors for controlling the adjustments of the width of the stretching chains in the upper run of the chain conveyor. The output signals from the control unit are applied to a switching or control system for the accelerator, to a regulation device for the entire processing line, and to driving units and feeding mechanisms of the feeding means for the line, respectively.

The continuous processing line of this invention makes possible a treatment of a large number of different kinds of textile webs. By virtue of the problem-free guidance in the range of the irradiation station, a more accurate and exact radiation treatment, and consequently a higher quality of the web, is achieved.

Of particular advantage is the substantially improved reliability of protection against radiation leakage. Both attending personnel and radiation-sensitive materials are, by means of this invention, protected against excessive doses of radiation. An important factor is also the coupling of pick-up elements of the radiation-protective system with the control unit for the entire processing line. In this manner, a flawless protection against radiation is achieved, both at a normal operation of the processing line and also in the case of an emergency.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
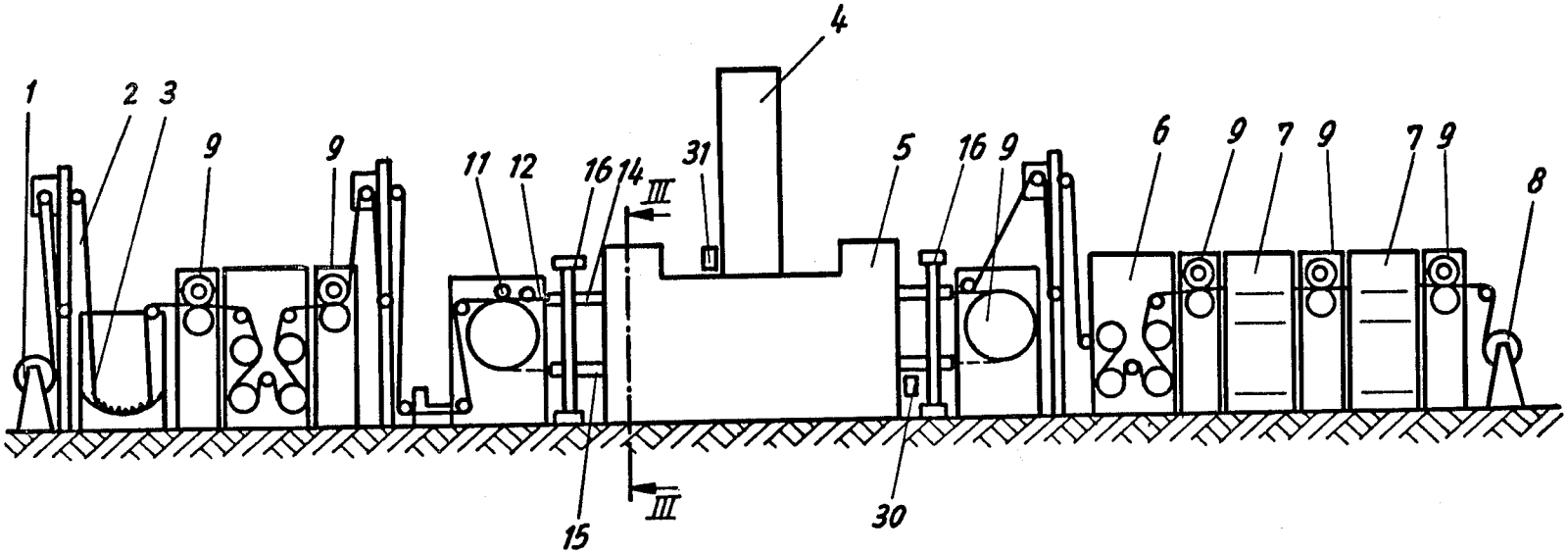
FIG. 1 is a schematic side view of a processing line of this invention.

Referring firstly to FIG. 1, it will be seen that the continuous processing line of this invention is assembled of consecutively arranged and kinematically coupled processing stations, namely of a supply station 1 for supplying a textile thread article in the form of a web 2, a liquid treatment station 3, an irradiation station 4 including a ray accelerator 4 having a ray exit window surrounded by an outer protective jacket 5 and cooperating with a web-feeding means in the form of a looped chain conveyor, a washing station 6, a drying station 7, and a station 8 for taking up and storing the processed web 2. Between respective processing stations there are arranged feeding mechanisms with drives 9. The aforementioned chain-conveyor feeding mechanism in the irradiation station 4 has guiding channels 14 for the upper run and guiding channels 15 for the lower run of conveying chains 12 of the conveyor. A stretching device with transverse means 11, such as for example in the form of holding needles, serves for applying the web 2 onto the upper run of the conveyor chains 12, which may include either holding needles or pliers.

Depending on the employed web treatment technology, the web 2 to be treated may pass either through all the aforementioned treatment stations or only through a selected part thereof. For example, in an arrangement for low crumpling or creasing, web-guiding devices not illustrated in the drawing guide the web into the liquid treatment station 3 or bypass the washing station 6. It will be understood, however, that in any modification of the technology of treatment the web always passes through the irradiation station 4.

The outer protective jacket 5 of the irradiation station is provided with openings 13 through which the upper and lower guides 14 and 15 of the conveying chain 12 enter and leave the irradiation station. The upper chain guides 14 must be adjusted for guiding the upper run of chains 12 holding the web 2 to be treated in the space bounded by the outer protective jacket 5. The lower run of conveying chains 12 passing through the lower guiding channels 15 only return to the spreading and transfer device 11 and have no web-supporting function.

Both the upper and lower chain guides 14 and 15 are supported on suspension means 16, including mechanisms for adjusting the distance between the chains of the conveyor 12. The suspension means for adjusting the clearance of the conveyor chains are arranged in such a manner that the outer protective jacket 5 substantially encloses those portions of the chain guides 14 and 15 extending between the clearance-adjusting device.

Figure 2:
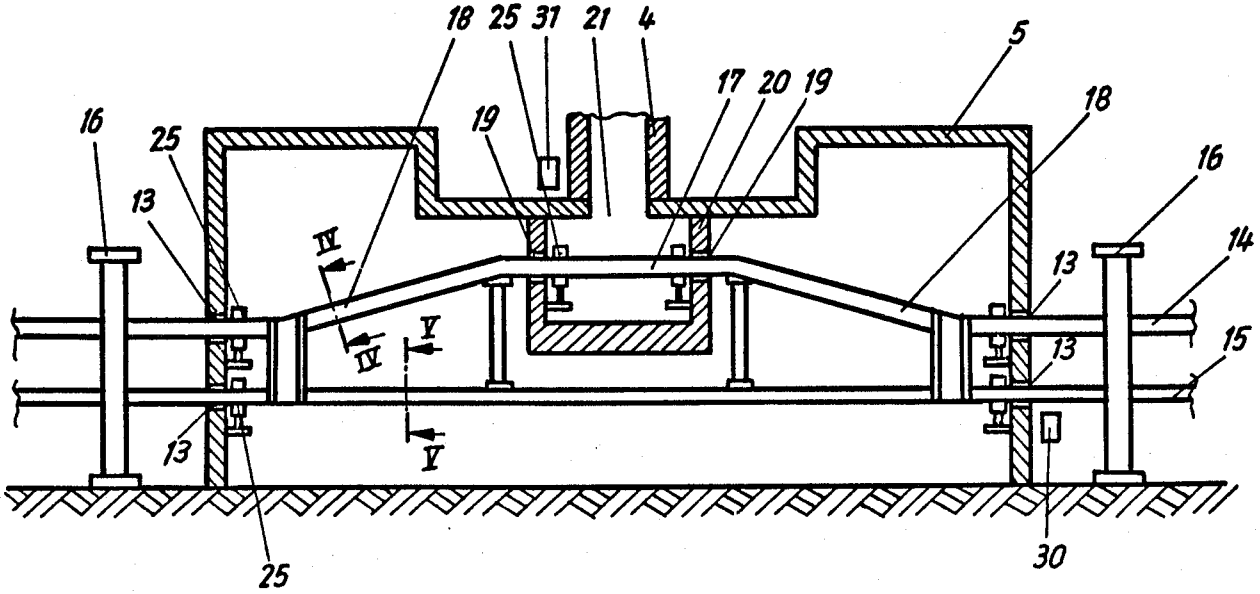
FIG. 2 is a transverse section taken through the irradiation station in FIG. 1.

As seen from FIG. 2, the lower guiding channels 15 in the range of the outer protective jacket 5 extend substantially along a straight line, the upper chain guides 14 in the range of the irradiation station have an angular configuration defining a central horizontal section 17 and two inclined lateral sections 18. The horizontal section 17 of both upper guides 14 passes through openings 19 and 20 in the opposite walls of an inner protective jacket 20, the interior of which communicates with the exit window 21 of the ray accelerator 4. This horizontal section 17 guides the treated web in a plane which is exactly parallel to the plane of the exit window 21. The sloping sections 18 of guiding channels 14 in the upper run of the conveyor are arranged symmetrically to the central section and to the exit window 21 and are directed to openings 13 in the walls of the outer protective jacket 5. The inner windows 19 and the outer windows 13 are vertically offset relative to each other and the angle of inclination of the sloping sections is determined by the vertical difference between the openings 19 and 13. Alternatively, the inner openings 19 can be arranged at a lower level than the outer openings 13.

Figure 3:
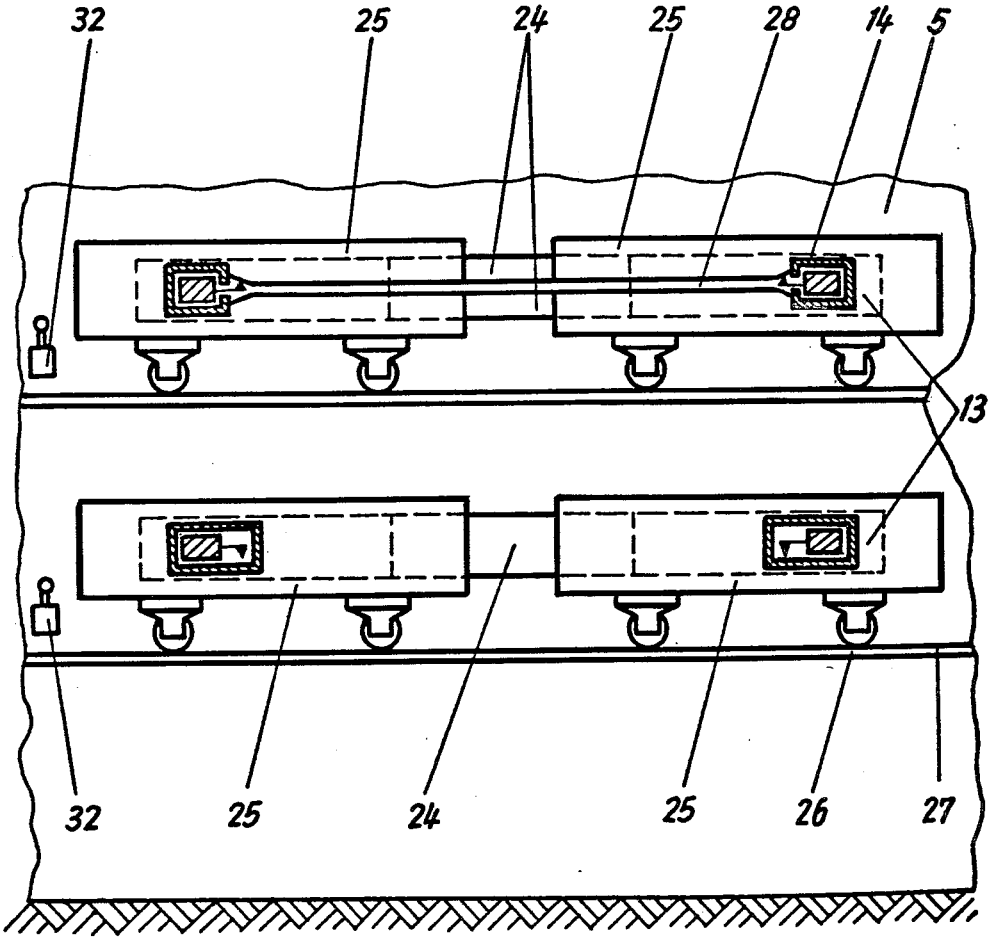
FIG. 3 is a transverse section of a cut away part of the irradiation station of FIG. 1, taken along the line III—III and shown on an enlarged scale.
Figure 4:
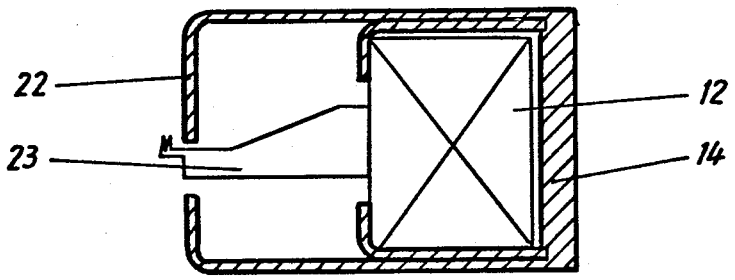
FIG. 4 is a section of a guiding channel taken along the line IV—IV in FIG. 2 and shown on an enlarged scale.
Figure 5:
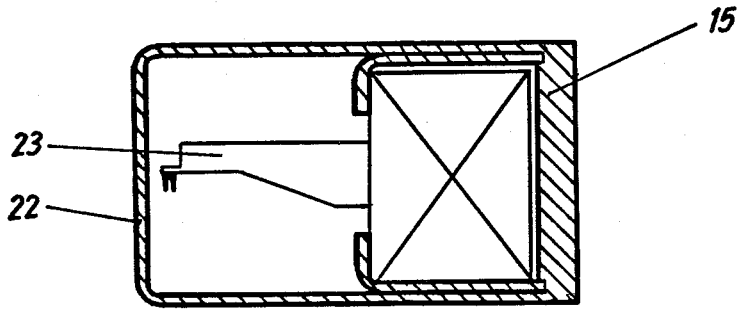
FIG. 5 is a section of a guiding channel for the lower run of a chain conveyor, taken along the line V—V and shown on an enlarged scale.
Figure 6:
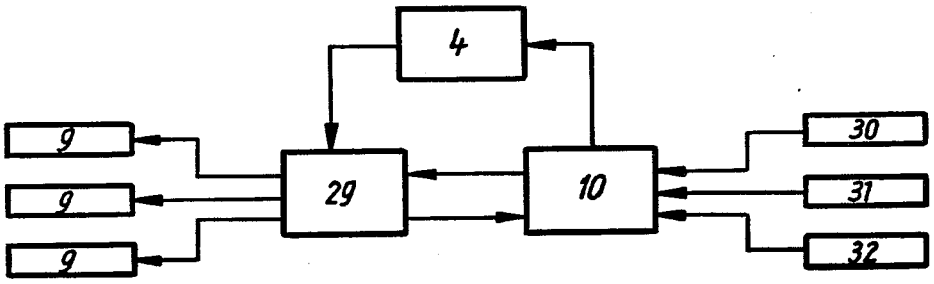
FIG. 6 is a block circuit diagram of a control system for the line of this invention.

According to another feature of this invention, both the upper chain guides 14 and the lower chain guides 15 are in the form of protective casings 22 surrounding the chains 12 of the conveyor, as illustrated in FIGS. 4 and 5. The upper guiding channels or casings 14, as seen from FIGS. 3 and 4, are each formed with a longitudinal slot 28 through which supporting arms 23 with holding needles for the web project opposite each other from respective chains 12, so as to catch the opposite edges of the web. In contrast, the lower chain-guiding channels 15, which serve only for guiding empty chains 12, are made without the guiding slot (FIG. 5).

As illustrated by dotted lines in FIG. 3, the outer openings 13 in the outer protective jacket 5, as well as the inner openings 19 in the inner jacket 20, have respectively an elongated form the length of which is defined by the maximum applicable width of the web 2 to be treated; similarly, the maximum adjustable distance between the chains 12, and accordingly between the guiding channels 14 and 15 both in the upper and the lower run of the chain conveyor, is determined by the maximum width of the web.

The openings 13 in the outer protective jacket 5 require a particularly effective protective arrangement against radiation leakage. For this purpose, in a central section of the elongated openings 13, there are provided stationary ray-screening blocks 24. In addition, displaceable ray-screening blocks 25 are rigidly connected to respective chain-guiding channels 14 and 15; as seen in FIG. 3, the movable screening blocks 25 are supported by means of rollers 26 for sliding movement on rails 27 and are dimensioned relative to the stationary protective block 24 in such a manner that, even when adjusting the maximum clearance between the movable blocks 25 and the corresponding guiding channels 14 and 15, the end portions of the movable blocks 25 still overlap with the stationary protective blocks 24.

The slot 28 which is formed in the guiding channels 14 in the upper run of the chain conveyor is formed also both in the displaceable screening blocks 25 and in the stationary screening block 24 so as to ensure unhindered passage through the irradiation stations 4 and 5 of web 2 held by the aforementioned needle bars projecting from respective chains 12 in the upper run of the chain conveyor.

The same arrangement of stationary and movable radiation-screening blocks 25 and 24 is provided at the opposite openings 13 and at the inner openings 19 in the inner protective jacket 20.

The movable and stationary screening blocks 24 and 25 assigned to the opposite outer openings 19 in the lower run of the conveyor passing through the outer protective chamber 5 are fully closed, that is they are made without the guiding slot 28 for the web. In a modification, namely when a web 2 is supported both on the upper and the lower run of the chain conveyor so as to be circulated on an endless loop, the movable and stationary protective blocks pertaining to the lower run are also made with the guiding slot 28 in the same manner as in the upper run.

The entire progressive processing line of this invention is controlled by means of a control device 29 which regulates all feeding drives 9 of respective stations constituting the processing line.

In addition, radiation sensors 30 are arranged at the outer surface of the outer protective jacket 5 near the outlet opening 13, and similarly radiation sensors 31 are provided at the outer surface of the junction point between the accelerator 4 and the protective jacket 5 to monitor and control the leakage or the radiation dose.

Additional sensors 32 are employed for controlling the adjustment of the clearance between chains 12 of the conveyor. These sensors 32 engage the displaceable radiation-screening blocks 25 when the adustable guiding channels 14 and 15 in respective upper and lower runs are displaced from each other over a maximum permissible distance.

All of these sensors 30, 31 and 32 are electrically connected to a control unit 10, which in turn regulates the irradiation and the operation of all treatment stations in the line; in other words, the output signals from the control unit 10 are applied to the control system for the ray accelerator 4 and, via the control device 29, to respective drives between the processing stations.

This sensor system, in cooperation with the aforedescribed adjustable radiation-screening devices of this invention, results in a comprehensive protection against radiation damage, both to the attending personnel and to materials sensitive to radiation, including the web portions outside the irradiation station.

The web 2, which is applied on the upper run of conveyor chains 12 by means of the spreading and transfer device 11, enters through slots 28 in the outer opening 13 the treatment space delimited by the outer protective jacket 5. The length of the elongated slots 28 in the protective or screening blocks 24 and 25 is determined by the width of the treated web 2, and to this web is also adjusted the clearance between the chains 12 and between the guiding channels 14 and 15.

In the event that the maximum permissible width of the web is exceeded, sensors 32 become activated and apply a control signal to the control unit 10, which in turn generates an output signal which deactivates the ray accelerator 4, on the one hand, and causes via the control device 29 the deenergization of drives 9 for feeding the web through the line. The simultaneously deactivation of the accelerator 4 assures that even if drives 9 stand still, the section of the web 2 occurring in the range of the exit window 21 of the accelerator 4 is not exposed to radiation for a longer time period than the remaining part of the web, and consequently any impairment of quality or complete damage of the web is eliminated.

As mentioned before, sensors 30 and 31 are responsive to radiation and induce the dosage control or a control in response to the radiation leakage. Output signals from the sensors 30 and 31 are compared in the control unit 10 with reference signals delivered by the control device 29, whereby the reference signals correspond to the maximum permissible dose of radiation. If such maximum values of radiation are exceeded by the detected signals, the unit 10 switches off the entire processing line in a manner similar to that described above.

In order to prevent radiation leakage from technologically necessary slots 28 in the protective blocks, there is provided the inner protective jacket 20 surrounding the ray exit window 21 and having its inlet and outlet openings 19 for the web arranged at a different level than the openings 13 in the outer protective jacket 5. Consequently, the guiding channels 14 for the upper run of the conveyor chains 12 are constituted with the aforedescribed angular shape.

Moreover, to prevent any impairment of conveyor chains 12 by the radiation emanating from the accelerator 4, the guiding channels 14 and 15 are made of a radiation-resistant material which substantially or completely encloses these conveyor chains.

It will be understood that each of the elements described above, or two or more together, may also find a useful application in other types of constructions differing from the types described above.

While the invention has been illustrated and described as embodied in a continuous line for treatment of a textile web, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A progressive line for irradiation and chemical treatment of a textile web, comprising a succession of treatment stations including an irradiation station with a ray accelerator having a ray exit window for treating the textile web with electron rays; adjustable conveyor means having an upper run for holding and advancing the web between the stations, and a lower run; said irradiation station being surrounded by an outer electron ray screening protective jacket formed with outer openings for passing through at least the upper run of the conveyor means together with the web, and also including an inner electron ray screening protective jacket surrounding the exit window of the ray accelerator and having inner openings for passing through the upper run with the web, the inner openings and the corresponding outer openings being vertically offset relative to each other; guiding channels arranged in the irradiation station for guiding and protecting the upper and lower runs of the conveyor means, the guding channel for the upper run having a central portion extending parallel to the plane of the ray exit window between said inner openings of the inner protective jacket, and two sloping lateral sections extending between the outer openings in the outer protective jacket and the inner openings, respectively; ray-shielding means including displaceable shielding blocks which are connected with the guiding channels and arranged for movement together therewith along the inner and outer openings in a plane of the textile web for adjusting a clearance between the guiding channels in dependence upon a width of the textile web and cooperating to move in two opposite directions transversely to the web feeding direction; and control means arranged to sense the movement of the displaceable shielding blocks and to thereby control the ray accelerator and the conveyor means to convey the textile web.

2. A processing line as defined in claim 1, wherein said conveyor means is a chain conveyor arranged to hold the textile web at its lateral edges, and further including means for adjusting the width of said chain conveyor and for adjusting the corresponding clearance between the guiding channels in the upper run and in the lower run of the conveyor.

3. A processing line as defined in claim 2, wherein said guiding channels at least in the upper run of said conveyor passing through the irradiation station are in the form of elongated casings defining a slot for holding means for the web.

4. A progressive line as defined in claim 3, wherein said shielding means includes stationary shielding blocks cooperating with said displaceable shielding blocks and each of said blocks being formed with a slot for passing through the treated web.

5. A progressive line as defined in claim 4, wherein said displaceable shielding blocks are mounted onto said guiding channels.

6. A progressive line as defined in claim 1, further including, consecutively arranged upstream of the irradiation station, a web supply station, a station for treating the web by a liquid, and downstream of the irradiation station, a drying station and a washing station, said stations including driving means for respective conveyors; and said control means including a control unit for controlling said ray accelerator and said driving means, a plurality of radiation sensors arranged at the outer surface of said outer protective jacket for monitoring the radiation leakage and the doses at the accelerator, and additional sensors for monitoring the adjustment of the width of the conveyor, said control unit being responsive to signals from said sensors to generate an output signal which in the event of excessive doses or leakage or in the event of feeding a web having an excessive width, switches off the driving means and the accelerator.

* * * * *